United States Patent [19]

Kunz

[11] 4,203,230

[45] May 20, 1980

[54] HAIR DRYER WITH COMPACTABLE BONNET

[75] Inventor: Raymond W. Kunz, Monroe, Conn.

[73] Assignee: Clairol Incorporated, New York, N.Y.

[21] Appl. No.: 916,993

[22] Filed: Jun. 19, 1978

[51] Int. Cl.[2] ..... A45D 20/32

[52] U.S. Cl. ..... 34/99; 34/239

[58] Field of Search ..... 34/90, 91, 99, 100, 34/239; 248/178

[56] References Cited

U.S. PATENT DOCUMENTS

| | | | |
|---|---|---|---|
| 2,575,841 | 11/1951 | Rosli | 34/99 |
| 3,064,360 | 11/1962 | Sholin | 34/91 |
| 3,418,726 | 12/1968 | Sparks | 34/99 |
| 3,777,406 | 12/1973 | Nopanen | 34/99 |

*Primary Examiner*—Larry I. Schwartz

*Attorney, Agent, or Firm*—Gerald S. Rosen; George A. Mentis

[57] ABSTRACT

A salon-type hair drying device is provided, which is easily collapsable when the device is not in use. The device includes a hair dryer in a storage case. Attachable to the hair dryer is a bonnet through a stem plenum portion of which heated air from the dryer is directed into its head surrounding portion and onto a person's hair to be dried. The bonnet is maintained in place on the person's head, without otherwise being held, by a support member that attaches to the dryer and extends through the bonnet's stem plenum portion. When the device is not in use, the support member, which is preferably made of a tape measure type metal, is rolled up with the bonnet and stored in the case with the dryer.

3 Claims, 4 Drawing Figures

HAIR DRYER WITH COMPACTABLE BONNET

BACKGROUND OF THE INVENTION

This invention relates to a device for drying hair. More specifically, it relates to a salon-type hair drying device that when in use needs not be held by the user, but is self-supported, and when not in use is collapsable for storage.

One known salon hair dryer has both a rigid base, which generally encloses components for producing heated air and a rigid stem with head surrounding portion through which the heated air is directed for hair drying. This dryer is not collapsable for storage or easily transportable, but also does not require that the person using the dryer hold it. The hair drying device of this invention is an improvement over this known dryer because it is both collapsable for storage, yet self supporting in use.

SUMMARY OF THE INVENTION

A device for drying hair is provided. The device includes a storage case, a hair dryer mounted for pivotal movement in the case, a flexible bonnet attachable to the air outlet end of the dryer, and a bonnet support member, which in use attaches to the dryer and extends through the bonnet for supporting the bonnet on a person's head and which not in use rolls up for storage with the bonnet and dryer in the storage case. Preferably, the support member is made of a tape measure type metal that is sufficiently rigid to support the bonnet, but flexible enough to be rolled up.

DETAILED DESCRIPTION OF THE INVENTION

Figure 1:
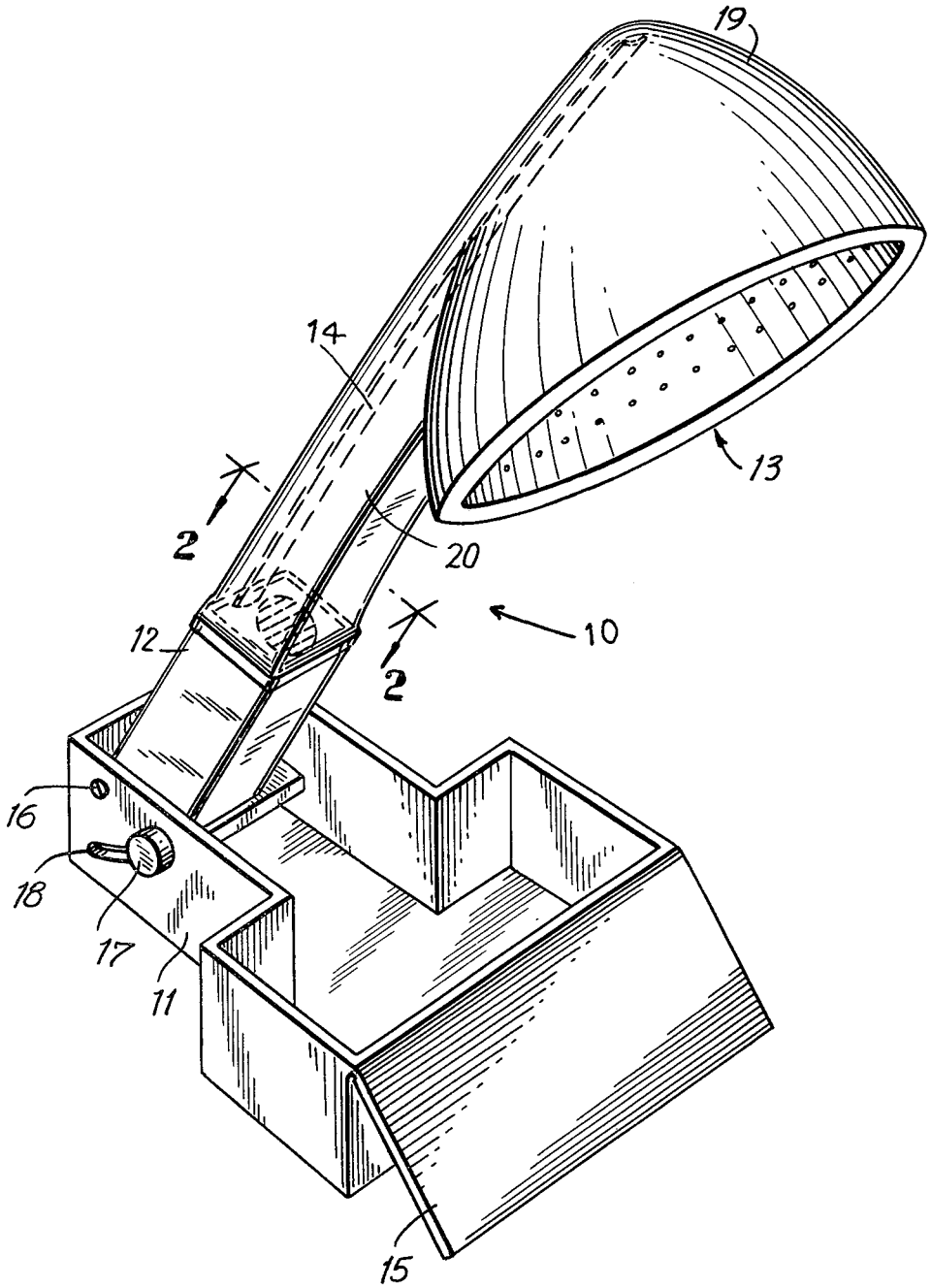
FIG. 1 is a perspective view of the device of this invention.
Figure 2:
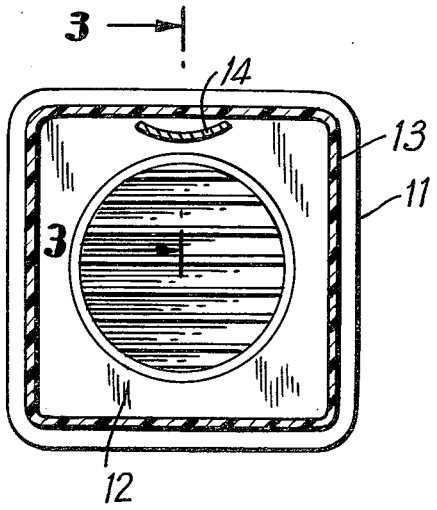
FIG. 2 is a cross-sectional view along lines 2—2 of FIG. 1.

Referring to FIG. 1, the device 10 includes a storage case 11, a hair dryer 12, a bonnet 13, and a bonnet support member 14.

Storage case 11 has a lid 15 which closes over the top of the case when the bonnet, support member, and dryer are stored therein. Dryer 12 is pivotally mounted in case 11 by a pivot screw 16 so that the air outlet end of the dryer can be positioned by the user as desired. A locking pin 17 integral with the dryer extends through a slot 18 in the case for holding the dryer at the angle selected. Dryer 12 is a conventional hair dryer, the structural details of which are not important to this invention because any of several hand-held dryer components can be used herein without departing from the spirit of this invention.

Bonnet 13 is made of plastic or a similiar material resistant to the temperatures normally encountered in hair drying. The bonnet has a head surrounding portion 19 and a stem plenum portion 20. Elastic or another conventional grasping means is used to attach the inlet end of bonnet 13 to the outlet end of dryer 12, so that heated air produced by the dryer may be directed through the stem plenum and head surrounding portions of the bonnet to the person's hair being dried.

Figure 3:
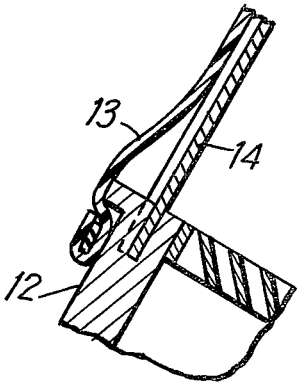
FIG. 3 is a cross-sectional view along lines 3—3 of FIG. 2.
Figure 4:
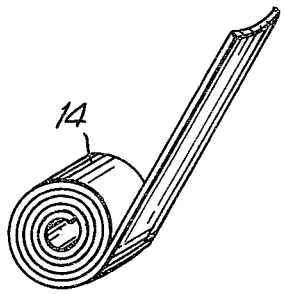
FIG. 4 is a perspective view of the bonnet support member of the device of FIG. 1 in its rolled up condition.

As shown best in FIG. 3, the end of bonnet support member 14 fits into a slot in the outlet end of dryer 12. When in use member 14 is rigid, so as to support bonnet 13. However, when the device is not in use, member 14 may be rolled up, as shown in FIG. 4, with bonnet 13 to be stored in case 11. Preferably, the support member is made of a flexible metal having sufficient rigidity to support the bonnet, but may also be made of other similar materials.

What is claimed is:

1. A device for drying hair comprising a self-supported hair dryer, a bonnet through which heated air from the hair dryer is directed onto a person's hair to be dried, said bonnet including a stem plenum portion and a head surrounding portion and an extensible bonnet support member attached to the hair dryer by being inserted into a slot therein, and extending through said stem plenum portion and said head surrounding portion of the bonnet, said support member being a flexible metal of a tape measure type structure having sufficient rigidity to support the bonnet and being rolled up into a coiled position when the hair dryer is not in use and is positioned for storage and being in an extended, uncoiled position when the bonnet is in place on the person's head.

2. The device of claim 1 further comprising a storage case in which the hair dryer is affixed and which is adapted to hold the bonnet and support member when the device is not in use.

3. The device of claim 2 wherein the hair dryer is pivotally mounted in the case.

* * * * *